US008646274B2

(12) United States Patent
Hicks

(10) Patent No.: US 8,646,274 B2
(45) Date of Patent: Feb. 11, 2014

(54) TOROIDAL MOTOR

(76) Inventor: Marvin Wayne Hicks, Silsbee, TX (US)

( * ) Notice: Subject to any disclaimer, the term of this patent is extended or adjusted under 35 U.S.C. 154(b) by 53 days.

(21) Appl. No.: 13/385,045

(22) Filed: Jan. 30, 2012

(65) Prior Publication Data

US 2013/0195706 A1 Aug. 1, 2013

(51) Int. Cl.
*F01K 25/00* (2006.01)

(52) U.S. Cl.
USPC ..... 60/671; 60/670; 60/623; 418/33; 418/35; 418/226; 418/227

(58) Field of Classification Search
USPC ..... 60/670, 614, 616, 618, 623, 655; 418/38, 35, 33; 123/241, 243, 245, 123/18 A, 18 R
See application file for complete search history.

(56) References Cited

U.S. PATENT DOCUMENTS

| | | | | |
|---|---|---|---|---|
| 1,705,254 | A | 5/1926 | Jaffe | |
| 1,993,585 | A * | 3/1935 | Baumann et al. | 122/145 |
| 2,760,466 | A * | 8/1956 | Black, Jr | 123/203 |
| 2,832,194 | A * | 4/1958 | Kuhner | 60/39.17 |
| 3,311,093 | A * | 3/1967 | De Castelet Gaetan De Coye | 418/61.3 |
| 3,958,419 | A * | 5/1976 | Laing | 60/397 |
| 4,035,111 | A | 7/1977 | Cronen, Sr. | |
| 4,242,591 | A | 12/1980 | Harville | |
| 4,636,157 | A * | 1/1987 | Van der Werff | 418/225 |
| 4,753,073 | A | 6/1988 | Chandler | |
| 5,000,003 | A * | 3/1991 | Wicks | 60/618 |
| 5,046,465 | A | 9/1991 | Yi | |
| 6,546,908 | B1 | 4/2003 | Pekau | |
| 7,059,294 | B2 | 6/2006 | Wright | |
| 2010/0319346 | A1 * | 12/2010 | Ast et al. | 60/616 |

FOREIGN PATENT DOCUMENTS

| | | |
|---|---|---|
| CA | 1176990 | 10/1984 |

* cited by examiner

*Primary Examiner* — Kenneth Bomberg
*Assistant Examiner* — Wesley Harris

(57) ABSTRACT

The present invention provides for a toroidal motor comprising a centrally located output shaft, a circular plate centrally and transversely affixed to the output shaft, a toroidal cylinder located in the same plane as and to the outside edge of the circular plate, pistons affixed to the outside edge of the circular plate and residing in the toroidal cylinder. A circular timing track may be used to time the action of a knife gate assembly which may be configured to induce a camming action in the knife gate assembly, rotating the knife gate into the toroidal cylinder, blocking the cylinder just behind a passing piston. Pressurized fluid may be introduced between the knife gate and the rear of the immediate downstream piston to cause a differential pressure to propel the piston through the toroidal cylinder.

9 Claims, 10 Drawing Sheets

TOROIDAL MOTOR

BACKGROUND

The need for efficient energy usage is ever-increasing. Many advances have been made, in the last few decades, to provide more efficient conversion of the potential energy of fuel to useful mechanical energy. A strong focus has been placed on the conservation of energy to ensure that future generations have sufficient, reliable energy sources. Even with this focus, staggering amounts of energy are still lost daily from industrial smokestacks, combustion engine exhausts, and from us simply passing by the opportunities available to make the most of naturally available and renewable energy sources. A key component of efficient energy usage is the recovery of energy from waste heat sources. Developments must be made to reclaim energy wasted in our daily processes and to utilize readily available and non-polluting energy resources.

The internal combustion engine (ICE), with reciprocating pistons, is probably the most widely known device used to convert potential fuel energy to mechanical energy. This type engine is much more efficient and versatile today than it was just a few decades ago. It is capable of using a slightly wider variety of fuels than in the past. This type of engine, in vehicles, may be configured with an electric motor to provide a more efficient hybrid.

One problem with the internal combustion engine, with reciprocating pistons, is residence time of the ignited fuel in the power-producing zone. The burning fuel exits the engine in a state of incomplete combustion. The full amount of the potential energy of the fuel cannot be imparted upon the pistons of the engine. Downstream equipment is required to fully combust the fuel before it exits to the atmosphere.

Another group of internal combustion engines, that is not as widely known, includes orbital, round, and toroidal designs. Some engines of these designs are capable of providing a longer residence time for the ignited fuel, however, they still fall subject to the same problem as the internal combustion engine with reciprocating pistons. The residence time of the fuel is limited. This type of engine is also limited in the variety of fuels it can use.

The current use of ICE-electric hybrid systems, and totally electric systems (an electric motor and rechargeable battery banks), to provide mechanical energy, is a seemingly credible effort toward more efficient fuel usage and more environmentally friendly methods. However, much of the electric power used by these systems originates from fossil fuels. Also, the batteries, required to store and release electrical energy in these systems, create their own environmental problems.

Another problem with many of the previously mentioned designs is their lack of process flexibility. These designs would require significant modifications if they were to be used for the purpose of waste heat recovery.

SUMMARY OF THE INVENTION

The present invention aims to solve at least one of these and other problems.

It is an object of the present invention to provide a toroidal motor, wherein the potential energy of a pressurized fluid may be converted to mechanical energy.

It is another object of the present invention to provide a toroidal motor, wherein the potential energy of a pressurized fluid may be converted to mechanical energy, that is economical and easily applied to provide mechanical energy for almost any location desired. The present invention may be configured and constructed to be mobile or it may be configured and constructed to be stationary. The present invention is comprised of fewer moving parts and fewer total parts than reciprocating piston engines of comparable size.

It is another object of the present invention to provide an energy conversion system, employing a toroidal motor, wherein the potential energy of a pressurized fluid may be converted to mechanical energy, that is easily scalable to match the mechanical energy need of a user as well as scalable to match an energy source chosen to heat or pressurize the fluid used to provide potential energy to the toroidal motor.

It is another object of the present invention to provide a fluid heat energy recovery system, employing a toroidal motor, that will cause and encourage the employment of underutilized fluid heat sources. The scope of these fluid heat sources is almost unlimited. Geothermal wells, industrial coolant streams, exothermic chemical reactions, and hot gases from almost any combustion source are only a few fluid heat energy sources. The fluid heat energy recovery system is configured to operate at substantially "zero-emissions". The fluid heat energy recovery system configured with a user, such as an electric generator, could play a major role in the production of electricity from fluid heat energy with the entire configuration operating at substantially "zero-emissions".

In a preferred embodiment of the present invention, a toroidal cylinder is located centrally and transversely to an output shaft. A circular plate is located centrally and transversely to the output shaft and connected to the output shaft. The outside edge of the circular plate is configured to penetrate the inside wall of the toroidal cylinder in a manner allowing a seal to be configured between the wall of the toroidal cylinder and the top and bottom of the circular plate. At least one piston resides in the toroidal cylinder and is connected to the outside edge of the circular plate. A circular timing track, concentric to the circular plate and with a radius less than that of the circular plate, is connected to an interior surface of the circular plate. The circular timing track is configured with alternating flat and raised regions and is used to time the actions of a knife gate assembly. The knife gate assembly is configured to rotate a knife gate into the toroidal cylinder, substantially blocking the toroidal cylinder. The knife gate assembly is also configured to rotate the knife gate out of the toroidal cylinder, substantially clearing the knife gate from the toroidal cylinder. At least one high pressure fluid entrance is configured to allow the introduction of a pressurized fluid into the toroidal cylinder. At least one low pressure fluid exit is configured to allow the egress of the pressurized fluid once the pressurized fluid has expanded.

In a preferred aspect, the output shaft may pass through the housing of the toroidal motor. A seal may be used to substantially prevent any fluid, used within the toroidal motor, from exiting the toroidal motor to the atmosphere, at the point the output shaft passes through.

In another preferred aspect, a magnetic coupling assembly may be used to transfer the mechanical energy produced by the toroidal motor. The configuration of the magnetic coupling assembly would allow the output shaft of the toroidal motor to be fully enclosed within the toroidal motor housing. This substantially sealable toroidal motor housing configuration would allow the use of fluids that may possess potential detriment to the environment.

In another preferred embodiment of the present invention, an energy conversion system, comprising: a fluid for use in and substantially contained within the energy conversion system; at least one heating chamber for pressurizing the fluid; at least one condenser for cooling and for condensing the fluid;

at least one compressor for compressing the fluid and returning to the heating chamber; at least one toroidal motor, comprising: a high pressure fluid entrance for the fluid; a low pressure fluid exit for the fluid; an output shaft for transmission of energy from the toroidal motor; a toroidal cylinder, located centrally and transversely about the output shaft; a circular plate, located centrally and transversely about the output shaft and connected to the output shaft, configured such that the outside edge of the circular plate penetrates the inside wall of the toroidal cylinder; a piston, connected to the outside edge of the circular plate, residing in the toroidal cylinder, and moveable through the toroidal cylinder as the circular plate and the output shaft rotate; a knife gate assembly, configured to rotate a knife gate transversely into the toroidal cylinder, fully blocking the toroidal cylinder for a timed period, and configured to rotate the knife gate fully from the toroidal cylinder at the completion of the timed period; a circular timing track, centrally located and connected to an interior surface of the circular plate, configured with alternating flat and raised sections for timing actions of the knife gate assembly.

In a preferred aspect, the heating chamber may be an external combustion chamber, wherein the heating chamber comprises: an insulated heating chamber housing; an entrance for a fuel and air mixture; piping and burner jets configured to convey fuel and air mixture into the heating chamber; an exit for the fuel and air mixture once it is combusted; at least one heating or vaporizing tube, configured within the heating chamber, for pressurizing a fluid; at least one gas or vapor storage vessel, which may be configured partially within the heating chamber and welded to the wall of the heating chamber where it passes through the wall, and it may be configured internal to or external to the heating chamber.

In another preferred aspect, the heating chamber may be configured to use a heated fluid from an external source to heat the fluid contained within the energy conversion system. The heating chamber in this aspect comprises: an insulated heating chamber housing; an entrance for a heated fluid from an external source; an exit for the heated fluid from an external source; at least one heating or vaporizing tube, configured within the heating chamber, for pressurizing a fluid; at least one gas or vapor storage vessel, which may be configured partially within the heating chamber and welded to the wall of the heating chamber where it passes through the wall, and it may be configured internal to or external to the heating chamber. This configuration would be of great economic and environmental value because it would allow the energy conversion system to convert heat energy, contained in fluid waste heat streams, to mechanical energy.

In another preferred aspect, the energy conversion system may further comprise at least one surge vessel configured between the compressor and the heating chamber.

In another preferred aspect, the energy conversion system, in which a two-state fluid may be used, may further comprise at least one liquid pump configured in parallel with the compressor to pump the liquid portion of the fluid from a cooler or condenser to a heating or flashing tube (other equipment may be configured between the liquid pump and the heating or flashing tube).

DETAILED DESCRIPTION

In the following description, the use of "a", "an", or "'the" can refer to the plural. All examples given are for clarification only, and are not intended to limit the scope of the invention.

In the following descriptions, references are made to embodiments of the invention. System embodiments of the invention comprise more than one piece of equipment, and a system is configured so that a working fluid (referred to as "the fluid" or "a fluid" or "fluid"), that remains substantially within the system, may transfer from one piece of equipment to another, as necessary, in operation. While direct citation may not be given to certain elements, such as piping and valves configured between cited elements of an embodiment and used to convey and control conveyance of a fluid between cited elements of an embodiment, and sensors and controllers used to monitor and control the operation of an embodiment of the invention, these elements are intended to be part of the invention and would be apparent to one skilled in the art. This explanation is given for clarification only and is not intended to limit the scope of the invention.

Figure 1:
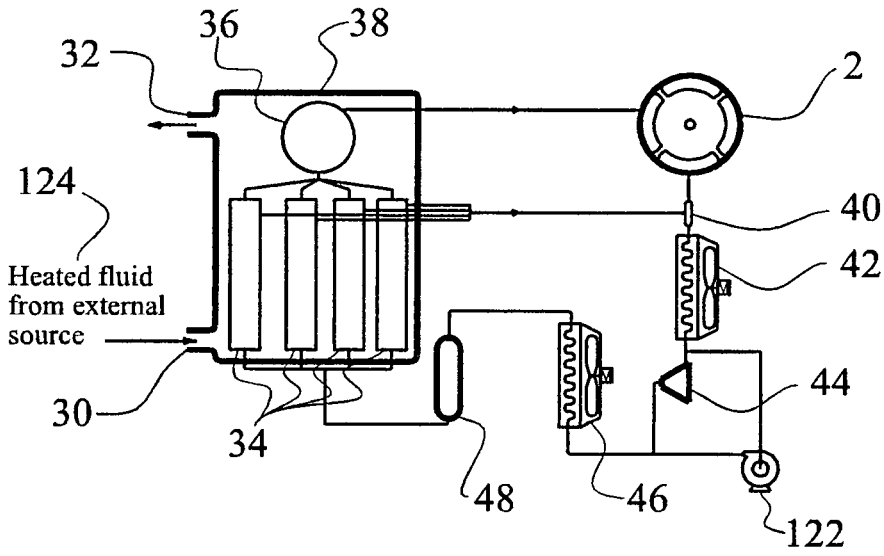
FIG. 1 shows a schematic view of a waste heat recovery system employing the toroidal motor described herein.

Referring to FIG. 1, according to a preferred embodiment, an energy conversion system includes a heating chamber 38, configured to receive heated fluid from an external source 124 through heated fluid entrance 30, and configured to allow the exit, of heated fluid from an external source 124, through heated fluid exit 32. At least one heating or flashing tube 34 is configured to reside internal to the heating chamber 38 and configured to be fully submerged in heated fluid from an external source 124, during operation. Heating or flashing tube 34 connects to a low pressure point 40 (not necessarily the lowest pressure location in the system) and connects to at least one gas or vapor storage vessel 36 which may be configured partially within the heating chamber 38 and welded to the wall of the heating chamber 38 where gas or vapor storage vessel 36 passes through the wall, and gas or vapor storage vessel 36 may be configured internal to or external to the heating chamber 38. The gas or vapor storage vessel 36 connects to at least one toroidal motor 2 which also connects to at least one cooler 42 which then connects to at least one compressor 44 and at least one pump 122 (in the case the fluid used in the energy conversion system is a two-state fluid) which may be configured parallel. Compressor 44 and pump 122 are connected to at least on condenser 46. Condenser 46 then connects to at least one surge vessel 48 which connects to heating or flashing tube 34.

In operation, the energy conversion system is configured to perform the following cycle with the energy conversion system at operational steady state, starting at point in the cycle such that heating or flashing tube 34 may be configured to receive fluid from surge vessel 48. Heated fluid from an external source 124 may be allowed to enter heating chamber 38 through heated fluid entrance 30, then flow through heating chamber 38, exiting heated fluid exit 32. The fluid in gas or vapor storage vessel 36 may be conveyed to toroidal motor 2 (toroidal motor 2 discussed later) where it may be expanded and then allowed to exit toroidal motor 2 at a lower pressure. The operating pressure range of the fluid in the gas or vapor storage vessel is preferably between 20 and 1000 psig, even more preferably between 100 and 600 psig. The energy conversion system is configured so that the fluid leaving the toroidal motor 2 may be conveyed to condenser 42 where the fluid may be cooled (and at least partially condensed in the case the fluid used in the energy conversion system is a two-state fluid) and then conveyed to compressor 44 and (in the case the fluid used in the energy conversion system is a two-state fluid) pump 122 which are configured to convey the gas and the liquid portions of the fluid, respectively, to cooler 46 where the fluid may be further cooled (and preferably at least nearly fully condensed in the case the fluid used in the energy conversion system is a two-state fluid). The energy conversion system is further configured to convey the fluid to surge vessel 48 and then to heating or flashing tube 34. Heating or flashing tube 34 is configured to then be isolated such that substantially no fluid may flow in or out. The fluid in heating or flashing tube 34 may then be heated by heated fluid from an external source 124. When the pressure of the fluid in heating or flashing tube 34 reaches a desired pressure above the pressure in gas or vapor storage vessel 36, the energy conversion system is configured such that the fluid in heating or flashing tube 34 may be released and allowed to convey to gas or vapor storage vessel 36 until pressures equalize in both. Heating or flashing tube 34 is configured to then be isolated from gas or vapor storage vessel 36. The remaining heated fluid in heating or flashing tube 34 may then be released to a low pressure point 40 between toroidal motor 2 and condenser 42. When the pressure in heating or flashing tube 34 nears the pressure between toroidal motor 2 and condenser 42, the energy conversion system is configured such that fluid may be conveyed from surge vessel 48 to push a majority of the remaining heated fluid out of heating or flashing tube 34 to the low pressure point 40. Heating or flashing tube 34 is configured to then be completely isolated so that the fluid contained within heating or flashing tube 34 may be heated by heated fluid from an external source 124. The energy conversion system may repeat this cycle as long as toroidal motor 2 is used to produce mechanical energy.

It would be obvious to one skilled in the art that a plurality of every piece of equipment in the energy conversion system could be employed within one system, or that more than one heating or flashing tube 34 may be filled or heated or discharged to more than one gas or vapor storage vessel 36 at a time.

A preferred usage of this embodiment of an energy conversion system would be as a waste heat energy recovery system. Routing a fluid waste heat stream through the heating chamber 38 could provide heat energy to the energy conversion system that would then be capable of providing mechanical energy that could be used directly, such as by a pump, or that could be used by a generator for electrical energy production. Another preferred usage of this embodiment of an energy conversion system would involve routing naturally occurring fluid heat streams, such as from geothermal wells, through the heating chamber 38.

Figure 2:
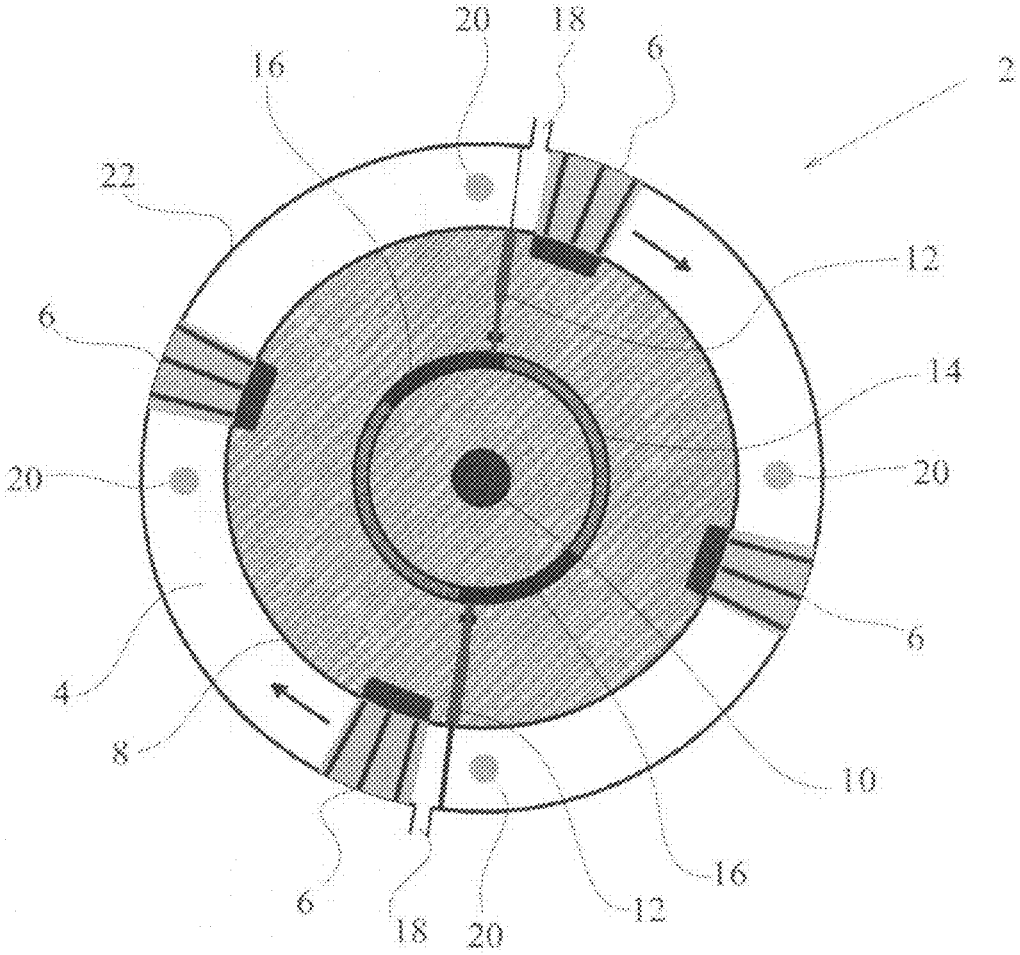
FIG. 2 shows a top, cutaway view according to a preferred embodiment of the toroidal motor described herein.

Referring now to FIG. 2, according to a preferred embodiment, a toroidal motor 2 comprises a circular plate 8 centrally and transversely located about an output shaft 10 and connected to output shaft 10. Circular plate 8 and output shaft 10 may be constructed of any hard material, preferably a metal. Output shaft 10 is configured to transfer mechanical energy, produced by toroidal motor 2, to users. Toroidal motor 2 is configured with a toroidal cylinder 4 that is located centrally and transversely about output shaft 10. The toroidal cylinder 4 may have any cross sectional geometry, preferably circular. Circular plate 8 is configured to penetrate the inner wall of toroidal cylinder 4 in a manner allowing a seal to be configured between the wall of the toroidal cylinder 4 and the top and bottom of the circular plate 8. The wall of the toroidal cylinder 4 may be the inner wall of an outer portion of toroidal motor housing 22, that is formed or machined to form toroidal cylinder 4 and polished smooth, or it may be constructed as a liner. The toroidal motor housing 22 may be constructed of any hard material capable of handling chosen operating parameters.

Toroidal motor 2 is configured with at least one piston 6 that is connected to the outer edge of circular plate 8 and resides in the bore of toroidal cylinder 4. The circumference of piston 6 may be very nearly that of toroidal cylinder 4 such that the surface of piston 6 may seal enough with the wall of toroidal cylinder 4 that significant pressure is not lost from the higher pressure area behind piston 6 to the lower pressure area ahead of piston 6. Preferably, the circumference of piston 6 may be just less than the circumference of toroidal cylinder 4 and thin sealing rings 94 (see FIG. 5*a*) may be mounted transversely on piston 6 to lessen friction between and create a better seal between piston 6 and the wall of toroidal cylinder 4. Piston 6 may be constructed of any hard material, preferably a metal. Toroidal motor 2 may be configured with a plurality of pistons 6, preferably between one and 16, even more preferably between two and eight. Movement of piston 6 through toroidal cylinder 4 causes rotation of circular plate 8 and output shaft 10.

Movement of piston 6 through toroidal cylinder 4 may be initiated or maintained by the introduction of a fluid into toroidal cylinder 4, via a high pressure fluid entrance 18, between the rear of piston 6 and a knife gate 74 (reference FIG. 6*b* and FIG. 6*c*) that substantially blocks toroidal cylinder 4. Knife gate 74 may be rotated into and out of toroidal cylinder 4 by the actions of knife gate assembly 12 (knife gate assembly 12 further discussed later). The actions of knife gate assembly 12 and the timing of those actions are controlled by circular timing track 14, which is centrally located and connected to an interior surface of said circular plate 8, and configured with alternating flat and raised sections. Toroidal motor 2 is configured with at least one low pressure fluid exit 20 to allow the fluid, that may be introduced into toroidal cylinder 4, to be exhausted once piston 6 moves past low pressure fluid exit 20. Toroidal motor 2 may be configured with a plurality of high pressure fluid entrances 18, and may be configured with a plurality of knife gate assemblies 12, a preferred configuration comprising an equal number of high pressure fluid entrances 18 and knife gate assemblies 12. Toroidal motor 2 may be configured with a plurality of low pressure fluid exits 20, a preferred configuration comprising at least as many low pressure fluid exits 20 as knife gate assemblies 12. Toroidal motor 2, in an even more preferred configuration, comprises at least as many low pressure fluid exits 20 as pistons 6, with the low pressure fluid exits 20 spaced at even intervals around toroidal cylinder 4. Toroidal motor 2 may be constructed in a wide range of sizes, from approximately four inches in diameter (outside span of toroidal cylinder) to greater than six feet in diameter.

Toroidal motor 2 may be configured with a braking and positioning system (not shown) that may be used to slow rotation (in the event toroidal motor 2 may be in operation) of pistons 6, circular plate 8, and output shaft 10 and used to cause pistons 6 to be stopped in a position such that restarting toroidal motor 2 may be as simple as allowing the fluid, used to supply energy to toroidal motor 2, to enter toroidal cylinder 4 via high pressure fluid entrance 18 and allowing the fluid to exhaust from toroidal cylinder 4 via low pressure fluid exit 20. One such braking and positioning system may comprise proximity sensors, controls, programming, piping, and valving such that it may cause a backpressure (in toroidal cylinder 4) through low pressure fluid exit 20 to slow piston 6 and then to stop piston 6, after piston 6 has slowed significantly and at a point piston 6 has just gone past high pressure fluid entrance 18. It would be apparent to one skilled in the art that toroidal motor 2 may be configured with this and other braking and positioning systems.

In operation, toroidal motor 2 is configured to perform the following cycle. This explanation starts at a point in the cycle where piston 6 has just gone by high pressure fluid entrance 18. Knife gate 74 is configured to be rotated into toroidal cylinder 4 at this point in the cycle (knife gate assembly 12 is in contact with a raised section 16 of circular timing track 14 at this point). A pressurized fluid may be introduced, through high pressure fluid entrance 18, into toroidal cylinder 4. Knife gate 74 is configured to minimize leakage, of the introduced fluid, out of toroidal cylinder 4. Piston 6 is moveable and the introduced fluid propels piston 6 through toroidal cylinder 4. As piston 6 rotates through toroidal cylinder 4, circular plate 8 and output shaft 10 are rotated, providing mechanical energy available to users via output shaft 10. As piston 6 reaches low pressure fluid exit 20, flow of pressurized fluid into toroidal cylinder 4 may be interrupted (by external controls and valving, to avoid continuing to introduce fluid behind a piston 6 if there is a low pressure fluid exit 20 located between the high pressure fluid entrance 18 introducing the fluid and the rear of piston 6) and knife gate 74 is withdrawn from toroidal cylinder 4 as knife gate assembly encounters a flat (lower) section of circular timing track 14. Just as the piston passes low pressure fluid exit 20, the expanded fluid begins to exhaust via low pressure fluid exit 20. Another piston 6 (in the case of an embodiment with more than one piston such as shown in FIG. 2) moves into the same location as the piston 6 was that was first noted in the cycle. Knife gate assembly 12 encounters another raised section 16 of circular timing track 14 and it activates to rotate knife gate 74 fully into toroidal cylinder 4. Toroidal motor 2 is configured to repeat this cycle as often as necessary.

There are many uses for toroidal motor 2. Toroidal motor 2, configured in an energy conversion system, could replace many internal combustion engines and less efficient (or less adaptable) external combustion engines. In preferred usages, toroidal motor 2, configured in an energy conversion system, can provide mechanical energy, directly to a user or to a generator for the production of electricity, at a lower cost than by most methods employed today. Toroidal motor 2 could even be configured in a mobile system, using a compressed, inert gas as motive force, for many uses in hazardous locations.

Figure 3:
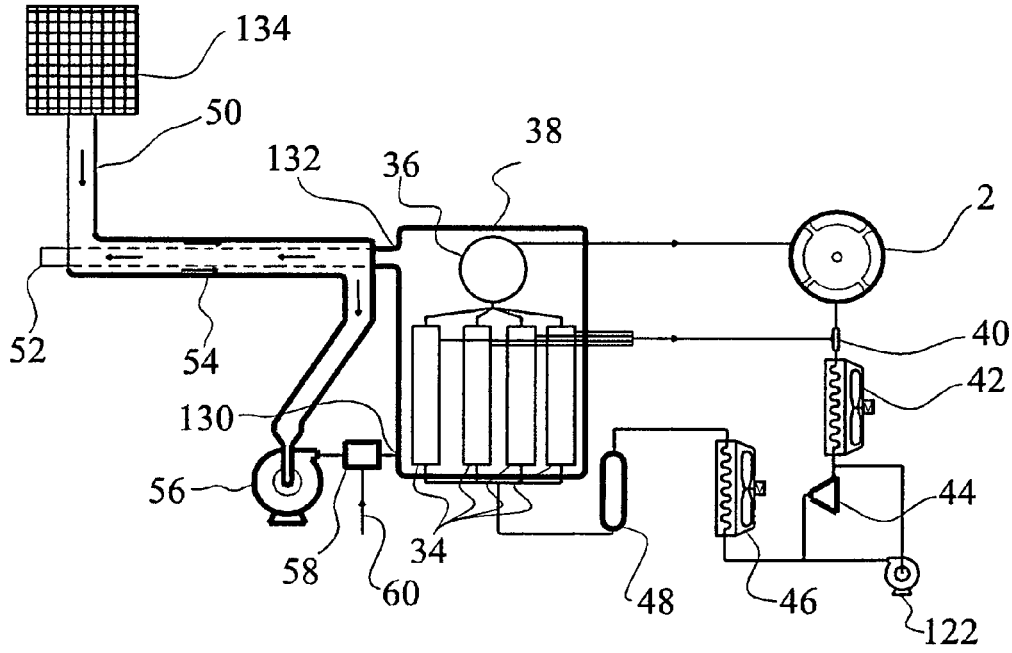
FIG. 3 shows a schematic view of a fuel-to-mechanical-energy system employing the toroidal motor described herein.

Referring now to FIG. 3, according to a preferred embodiment, an energy conversion system includes a heating chamber 38, configured to be an internal combustion chamber. Heating chamber 38 is configured to receive a fuel and air mixture via fluid entrance 130, to combust the fuel and air mixture internal to heating chamber 38, and to exhaust the combustion gases via fluid exit 132. The combustion gases may exit to the atmosphere through exhaust piping 52. Heating chamber 38 is configured such that air to be used for combustion, of a fuel, may be pulled into air intake piping 50 by combustion air pump 56. Air that may enter air intake piping 50 may be filtered by a filter 134. Combustion air pump 56 is connected to air and fuel mixing chamber 58 and is configured to force air into air and fuel mixing chamber 58. Air and fuel mixing chamber 58, wherein air and fuel may be mixed, is configured to receive air from combustion air pump 56 and to receive fuel from fuel supply 60, and is configured to allow the air and fuel mixture to convey (via piping and fluid entrance 130) into heating chamber 38. Air intake piping 50 and exhaust piping 52 may be configured so that a length of exhaust piping 52 resides fully internal and concentric to a length of air intake piping 50, the radius of this length of air intake piping 50 being sufficiently larger than the radius of exhaust piping 52 such that air intake flow may not be detrimentally restricted. This air intake piping 50 and exhaust piping 52 configuration allows for the preheating of air used for combustion, increasing overall energy conversion system efficiency.

At least one heating or flashing tube 34 is configured to reside internal to the heating chamber 38 and configured to be heated by hot gases from combustion of a fuel, during operation. Heating or flashing tube 34 connects to a low pressure point 40 (not necessarily the lowest pressure location in the system) and connects to at least one gas or vapor storage vessel 36 which may be configured partially within the heating chamber 38 and welded to the wall of the heating chamber 38 where gas or vapor storage vessel 36 passes through the wall, and gas or vapor storage vessel 36 may be configured internal to or external to the heating chamber 38. The gas or vapor storage vessel 36 connects to at least one toroidal motor 2 which also connects to at least one cooler 42 which then connects to at least one compressor 44 and at least one pump 122 which are configured parallel. Compressor 44 and pump 122 are connected to at least on condenser 46. Condenser 46 then connects to at least one surge vessel 48 which connects to heating or flashing tube 34.

In operation, the energy conversion system is configured to perform the following cycle with the energy conversion system at operational steady state, starting at point in the cycle such that heating or flashing tube 34 may be configured to receive fluid from surge vessel 48. Heated fluid from an external source 124 may be allowed to enter heating chamber 38 through heated fluid entrance 30, then flow through heating chamber 38, exiting heated fluid exit 32. The fluid in gas or vapor storage vessel 36 may be conveyed to toroidal motor 2 (toroidal motor 2 discussed later) where it may be expanded and then allowed to exit toroidal motor 2 at a lower pressure. The operating pressure range of the fluid in the gas or vapor storage vessel is preferably between 20 and 1000 psig, even more preferably between 100 and 600 psig. The energy conversion system is configured so that the fluid leaving the toroidal motor 2 may be conveyed to condenser 42 where the fluid may be cooled (and at least partially condensed in the case the fluid used in the energy conversion system is a two-state fluid) and then conveyed to compressor 44 and (in the case the fluid used in the energy conversion system is a two-state fluid) pump 122 which are configured to convey the gas and the liquid portions of the fluid, respectively, to cooler 46 where the fluid may be further cooled (and preferably at least nearly fully condensed in the case the fluid used in the energy conversion system is a two-state fluid). The energy conversion system is further configured to convey the fluid to surge vessel 48 and then to heating or flashing tube 34. Heating or flashing tube 34 is configured to then be isolated such that substantially no fluid may flow in or out. The fluid in heating or flashing tube 34 may then be heated by hot gases from combustion of a fuel. When the pressure of the fluid in heating or flashing tube 34 reaches a desired pressure above the pressure in gas or vapor storage vessel 36, the energy conversion system is configured such that the fluid in heating or flashing tube 34 may be released and allowed to convey to gas or vapor storage vessel 36 until pressures equalize in both. Heating or flashing tube 34 is configured to then be isolated from gas or vapor storage vessel 36. The heated fluid in heating or flashing tube 34 may then be released to a low pressure point 40 between toroidal motor 2 and condenser 42. When the pressure in heating or flashing tube 34 nears the pressure between toroidal motor 2 and condenser 42, the energy conversion system is configured such that fluid may be conveyed from surge vessel 48 to push a majority of the remaining heated fluid out of heating or flashing tube 34 to the low pressure point 40. Heating or flashing tube 34 is configured to then be completely isolated so that the fluid contained within heating or flashing tube 34 may be heated by hot gases from combustion of a fuel. The energy conversion system may be configured to repeat this cycle as long as toroidal motor 2 is used to produce mechanical energy.

It would be obvious to one skilled in the art that a plurality of every piece of equipment in the energy conversion system could be employed within one system, or that more than one heating or flashing tube 34 may be filled or heated or discharged to more than one gas or vapor storage vessel 36 at a time.

Figure 4:
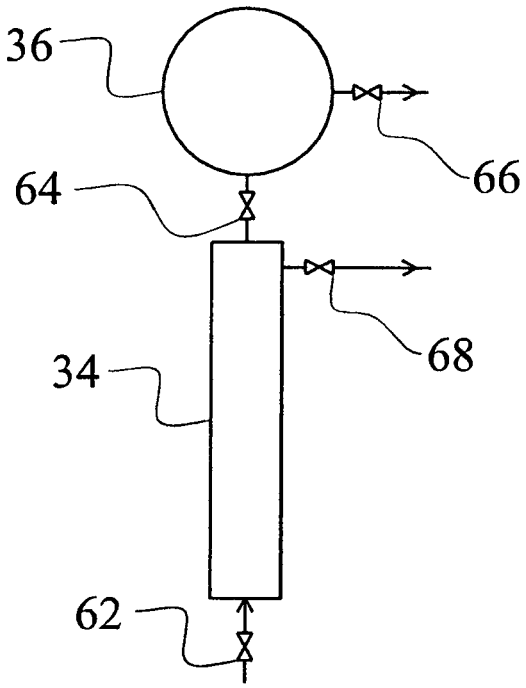
FIG. 4 shows a schematic view of a heating or flashing tube and a gas or vapor storage vessel configured together according to a preferred embodiment.

Referring now to FIG. 4, according to a preferred embodiment, a heating or flashing tube 34 and gas or vapor storage vessel 36 combination. Heating or flashing tube 34 is connected to gas or vapor storage vessel 36. Valve 62 is configured to control flow of fluid (used in an energy conversion system) into heating or flashing vessel 34. Valve 64 is configured to control flow of fluid from heating or flashing tube 34 to gas or vapor storage vessel 36. Valve 66 is configured to control flow of fluid from gas or vapor storage vessel 36. Valve 68 is configured to allow release of fluid from heating or flashing tube 34 (to a low pressure point 40 in an energy conversion system).

In operation, valve 64 and valve 68 are closed and valve 62 is open. Fluid (used in an energy conversion system) is conveyed into heating or flashing tube 34. Valve 62 is closed, isolating fluid to be heated. When the fluid is heated such that the pressure in heating or flashing tube 34 reaches a desired level above the pressure in gas or vapor storage vessel 36, valve 64 is opened and fluid is allowed to flow from heating or flashing tube 34 to gas or vapor storage vessel 36 until pressure is equalized. Valve 64 is then closed and valve 68 is opened, allowing the remaining heated fluid in heating or flashing tube 34 be released (to a low pressure point 40). When the pressure in heating or flashing tube 34 nears the pressure of low pressure point 40, valve 62 is opened and fluid is conveyed through valve 62 to push a majority of the remaining heated fluid out of heating or flashing tube 34 to the low pressure point 40. Valve 62 and valve 68 are closed. This cycle may be repeated as often as necessary.

Valve 66 is opened, closed, or position controlled (in the case that valve 66 is a flow control valve) according to the amount of fluid needed to operate toroidal motor 2.

This is a simplified illustration and is given to emphasize a preference for using the configuration using both pieces of equipment rather than either piece of equipment alone for the conditioning, storage, and dispensing of fluid to toroidal motor 2. This example is given are for clarification only, and is not intended to limit the scope of the invention.

Figure 5A:
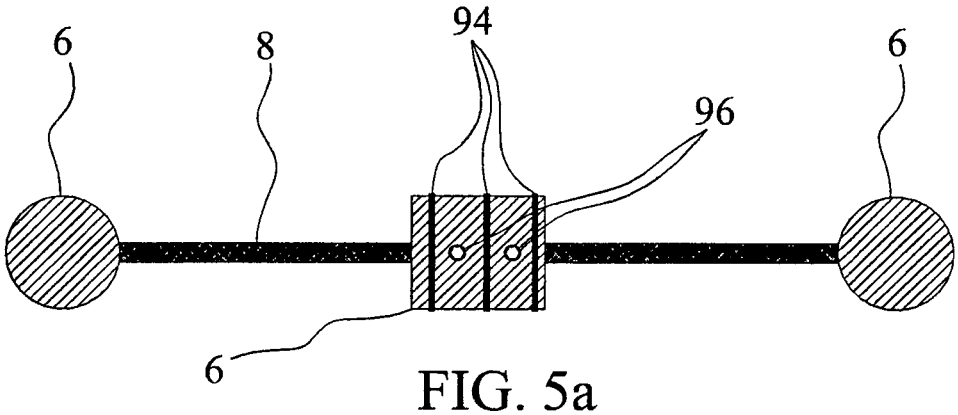
FIG. 5*a* shows a side view of the plate and piston assembly.

Referring now to FIG. 5*a*, in a preferred embodiment, piston 6 is connected to the outside edge of circular plate 8. Circular plate 8 may be configured to be flat and of uniform thickness throughout. Or, circular plate 8 may be configured with varying thicknesses or vertical and horizontal radial variations. Piston 6 may be connected to circular plate 8 by bolts 96, by welds, by integral casting of piston 6 with circular plate 8, or by other methods that would be apparent to one skilled in the art. Piston 6 may be configured with thin sealing rings 94. Piston 6 may be configured with more than one thin sealing ring 94, preferably from two to ten, even more preferably from three to six. Thin sealing ring 94 may be constructed of any hard material capable of substantially sealing between piston 6 and the wall of torodial cylinder 4, and capable of providing a low friction interface with the wall of toroidal cylinder 4, and capable of withstanding operating conditions chosen for toroidal motor 2.

Figure 5B:
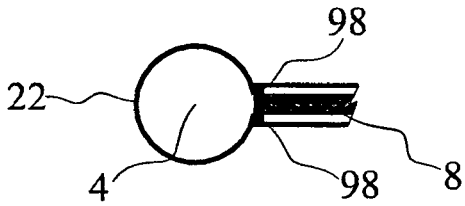
FIG. 5*b* shows a side, partial cutaway view of the toroidal motor housing in an area not housing the knife gate assembly.

Referring now to FIG. 5*b*, in a preferred embodiment, toroidal motor housing 22 is configured with toroidal cylinder 4. This drawing shows how toroidal motor housing 22 may be configured in areas of toroidal motor housing 22 away from knife gate assembly 12. Circular plate 8 is configured such that the outside edge of circular plate 8 penetrates the inside wall of toroidal cylinder 4. Toroidal motor housing 22 is configured such that toroidal cylinder 4 may be substantially sealed with circular plate 8 by seals 98. Seals 98 and circular plate 8 are configured such that circular plate 8 may rotate freely while in contact with seals 98.

Figure 6A:
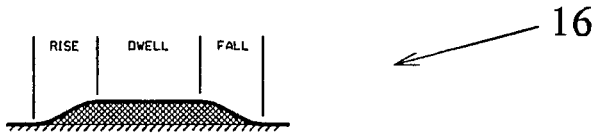
FIG. 6*a* shows a schematic view of knife gate timing mechanism.

Referring now to FIG. 6*a*, in a preferred embodiment, a raised section 16 of circular timing track 14 is configured to cause knife gate assembly 12 to activate and rotate knife gate 74 into toroidal cylinder 4 as the rise portion of raised section 16 is moved into contact with knife gate assembly 12. Knife gate 74 is configured to remain rotated into toroidal cylinder 4 for the duration that knife gate assembly 12 remains in contact with the dwell portion of raised section 16. Knife gate 74 is configured to begin rotating out of toroidal cylinder 4 as knife gate assembly 12 contacts the fall portion of raised section 16. Knife gate 74 is configured to be completely clear of toroidal cylinder 4 as knife gate assembly 12 first contacts the flat area of circular timing track 14.

Figure 6B:
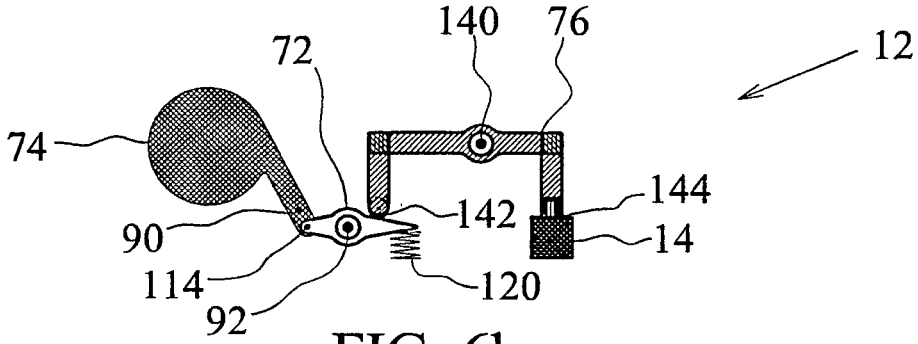
FIG. 6*b* shows a schematic view of the knife gate assembly in the open position.
Figure 6C:
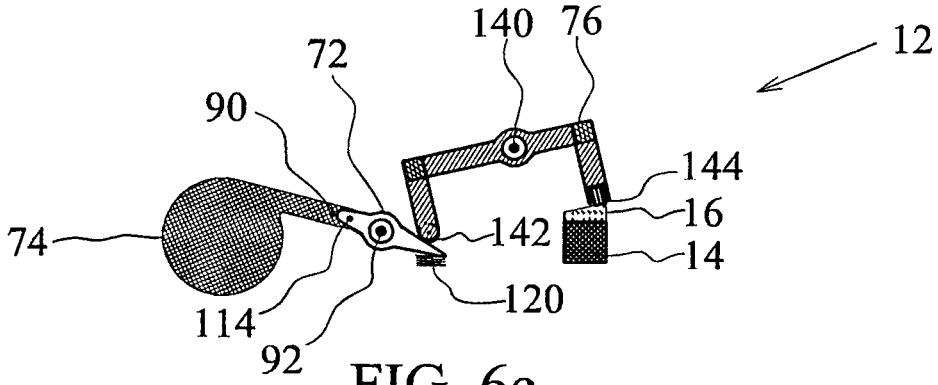
FIG. 6*c* shows a schematic view of the knife gate assembly in the closed position.

Referring now to FIG. 6*b* and FIG. 6*c*, in a preferred embodiment, a knife gate assembly 12 includes a knife gate 74 connected to an internal area of toroidal motor housing 22 by wrist pin 90. Knife gate 74 is configured to be rotatably moveable about wrist pin 90. Knife gate 74 is connected to secondary rocker arm 72 by connecting pin 114. Secondary rocker arm 72 is connected to an internal area of toroidal motor housing 22 by wrist pin 92. Secondary rocker arm 72 is configured to be rotatably moveable about wrist pin 92. A flattened section of secondary rocker arm 72 is configured to substantially constantly contact roller 142. Roller 142 and secondary rocker arm 72 are configured such that roller 142 may roll back and forth along the flattened section of secondary rocker arm 72 during actions of knife gate assembly 12. Roller 142 is connected to one end of primary rocker arm 76. The other end of primary rocker arm 76 is connected to roller 144, with knife gate assembly 12 and circular timing track 14 configured such that roller 144 remains in substantially constant contact with circular timing track 14. Primary rocker arm 76 is connected to an internal area of toroidal motor housing 22 by wrist pin 140. Primary rocker arm 76 is configured to be rotatably moveable about wrist pin 140. Spring 120 may be configured to be held securely to an internal area of toroidal housing 22, at one end, and may be configured to hold a constant pressure against secondary rocker arm 72 such that spring 120 would be compressed when knife gate assembly 12 is activated to rotate knife gate 74 into toroidal cylinder 4 and such that spring 120 would supply the force necessary to activate knife gate assembly 12 to rotate knife gate 74 completely from toroidal cylinder 4 when is not in contact with a raised section 16 of circular timing track 14. It would be apparent to one skilled in the art that there are many types and configurations of mechanisms, constructed of various materials, that could perform the function as described for spring 120.

FIG. 6*b* depicts knife gate assembly 12 in contact with a flat region of circular timing track 14 such that knife gate 74 would be rotated fully from toroidal cylinder 4. FIG. 6*c* depicts knife gate assembly 12 in contact with the dwell region of raised section 16 of circular timing track 14 such that knife gate 74 would be rotated fully into toroidal cylinder 4.

Figure 7:
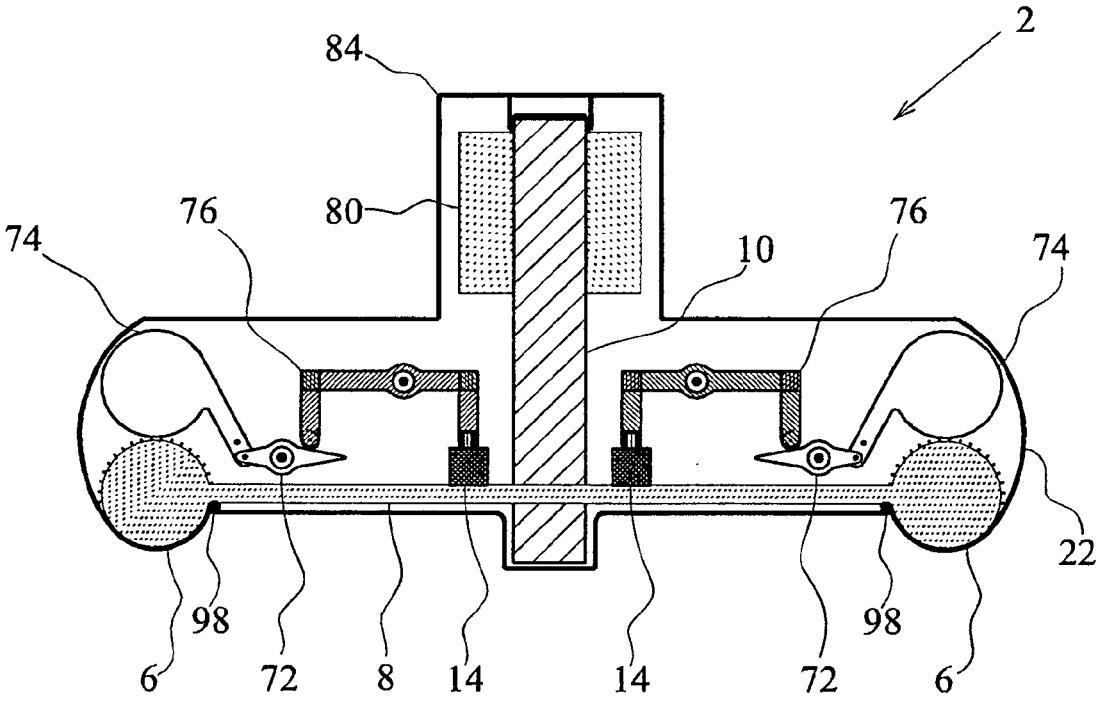
FIG. 7 shows a side, cutaway view according to a preferred embodiment of the toroidal motor described herein.

Referring now to FIG. 7, according to a preferred embodiment, a toroidal motor 2 (previously described) configured to be substantially sealable. In this description, the term "sealable" applies to areas where faces of segments (segments or segment faces not shown) of toroidal motor housing 22 meet and where they are intended to seal or to be sealed such that fluid used internal to toroidal motor housing 22 may be substantially contained within toroidal motor housing 22. (This description and explanation does not apply to the entering of fluid via high pressure fluid entrance 18 and the exiting of fluid via low pressure fluid exit 20 which are necessary for the operation of toroidal motor 2). Driving portion 80 of magnetic coupling assembly is connected to output shaft 10. Magnetic coupling assembly to be described later. Sealing cap 84 covers driving portion 80 of magnetic coupling assembly 80, is part of toroidal motor housing 22, and is connected to and may be sealed with toroidal motor housing 22.

FIG. 7 also depicts a side view of a toroidal motor 2, with a sealable toroidal motor housing 22 cutaway, at a position to show a preferred configuration of toroidal motor housing 22 such that it can house knife gate assembly 12 and provide room for the movements of knife gate assembly 12.

Figure 8:
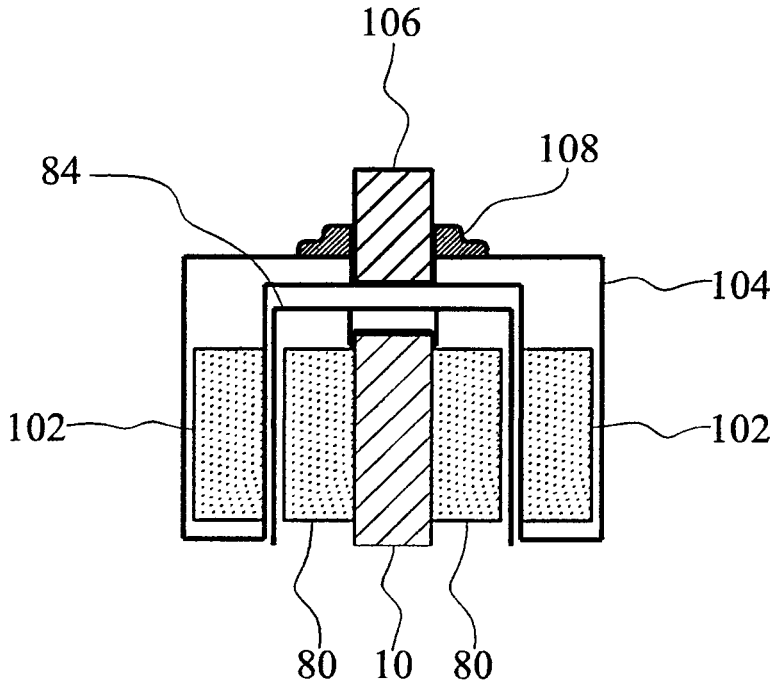
FIG. 8 shows a side, cutaway view of the magnetic coupling assembly.

Referring now to FIG. 8, in a preferred embodiment, a magnetic coupling assembly may be configured such that driving portion 80 of the magnetic coupling assembly is connected to output shaft 10 of toroidal motor 2. Driving portion 80 of the magnetic coupling assembly may be constructed of extremely strong, magnetic material, and constructed of sufficient size and strength to transfer mechanical energy, produced by toroidal motor 2, to a driven portion 102 (constructed of same material as driving portion 80) of the magnetic coupling assembly. Driving potion 80 and driven portion 102, of the magnetic coupling assembly, are configured to be separated by sealing cap 84 of toroidal motor housing 22. Driven portion housing 104, of the magnetic coupling assembly, is configured to house driven portion 102 and configured to rotate as driving portion 80 of the magnetic coupling assembly rotates. Driven portion housing 104 is connected to secondary output shaft 106 such that mechanical energy produced by toroidal motor 2 may be available to users via secondary output shaft 106. Stiffening ring 108 may be connected to driven portion housing 104 and connected to secondary output shaft 106 for increased stabilization of secondary output shaft 106.

Figure 9:
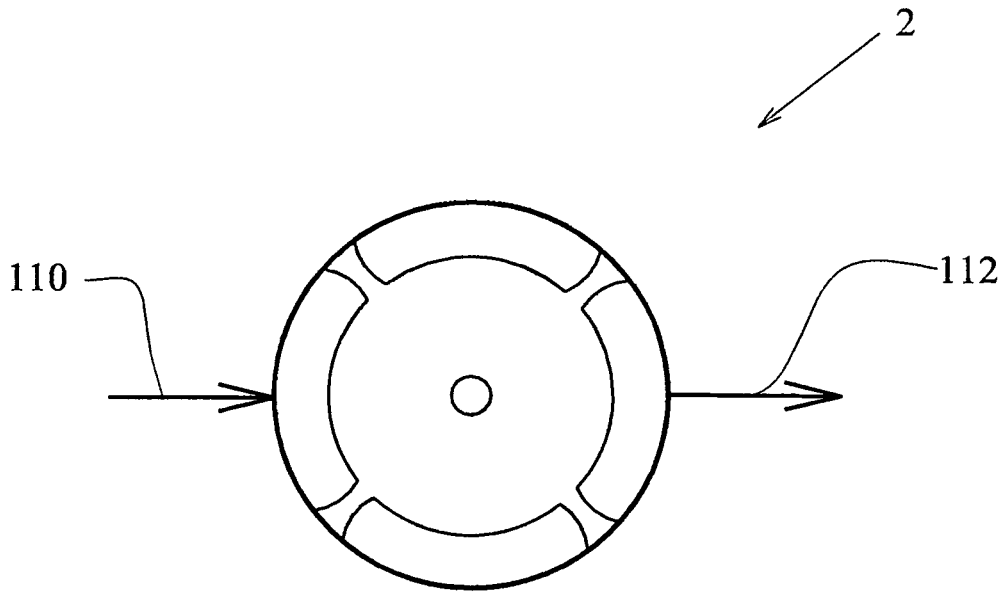
FIG. 9 shows a schematic view according to another preferred embodiment of the toroidal motor described herein.

Referring now to FIG. 9, in a preferred embodiment, toroidal motor 2 may be easily configured to use environmentally friendly fluids. This drawing is a simple illustration to emphasize the ease with which a fluid, such as compressed air, may be used as motive force for toroidal motor 2. In the case of compressed air, compressed air could be supplied from source 110 to toroidal motor 2, used by toroidal motor 2, and then exhausted to a safe location.

Figure 10:
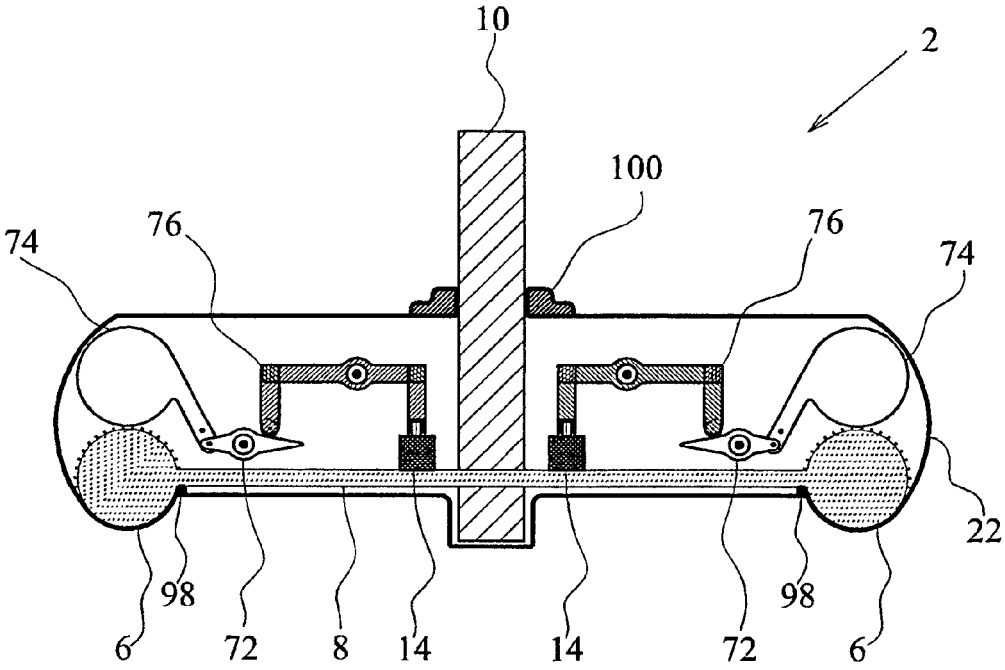
FIG. 10 shows a side, cutaway view of the toroidal motor in FIG. 9.

Referring now to FIG. 10, in a preferred embodiment, toroidal motor 2 may be configured with output shaft 10 passing through toroidal motor housing 22. Seal 100 may be connected to toroidal motor housing 22 and may be configured to substantially seal around output shaft 10.

I claim:

1. A toroidal motor, comprising:

a toroidal motor housing;

a high pressure fluid entrance for a fluid;

a low pressure fluid exit for said fluid;

an output shaft for transmission of mechanical energy from said toroidal motor;

a toroidal cylinder, located centrally and transversely about said output shaft;

a circular plate, located centrally and transversely about said output shaft and connected to said output shaft, configured such that the outside edge of said circular plate penetrates the inside wall of said toroidal cylinder, and configured geometrically solid between said output shaft and said outside edge;

a piston, connected to the outside edge of said circular plate, residing in said toroidal cylinder, and moveable through said toroidal cylinder as said circular plate and said output shaft rotate;

a knife gate assembly, configured to rotate a knife gate transversely into said toroidal cylinder, and configured to rotate said knife gate assembly from one side of said toroidal cylinder to the other side of said toroidal cylinder, fully blocking said toroidal cylinder for a timed period, and configured to rotate said knife gate fully from said toroidal cylinder at the completion of said timed period;

a circular timing track, centrally located and connected to an interior surface of said circular plate, configured with alternating flat and raised sections for timing actions of said knife gate assembly.

2. The toroidal motor as claimed in claim 1, further comprising:

a magnetic coupling assembly used to transfer said mechanical energy to a user, comprising:

a driving portion of said magnetic coupling assembly, connected to an output end of said output shaft, internal to a toroidal motor housing;

a driven portion of said magnetic coupling assembly, external to said toroidal motor housing; and, a portion of said toroidal motor housing, configured to separate said driving portion of said magnetic coupling assembly from said driven portion of said magnetic coupling assembly, and configured to make said toroidal motor housing substantially sealable.

3. An energy conversion system, comprising:

a fluid for use in said energy conversion system and substantially contained within said energy conversion system;

at least one heating chamber for pressurizing said fluid;

at least one condenser for cooling and for condensing said fluid;

at least one compressor for compressing said fluid and returning said fluid to said heating chamber;

at least one toroidal motor, comprising:

a high pressure fluid entrance for said fluid;

a low pressure fluid exit for said fluid;

an output shaft for transmission of mechanical energy from said toroidal motor;

a toroidal cylinder, located centrally and transversely about said output shaft;

a circular plate, located centrally and transversely about said output shaft and connected to said output shaft, configured such that the outside edge of said circular plate penetrates the inside wall of said toroidal cylinder, and configured geometrically solid between said output shaft and said outside edge;

a piston, connected to the outside edge of said circular plate, residing in said toroidal cylinder, and moveable through said toroidal cylinder as said circular plate and said output shaft rotate;

a knife gate assembly, configured to rotate a knife gate transversely into said toroidal cylinder, and configured to rotate said knife gate assembly from one side of said toroidal cylinder to the other side of said toroidal cylinder, fully blocking said toroidal cylinder for a timed period, and configured to rotate said knife gate fully from said toroidal cylinder at the completion of said timed period;

a circular timing track, centrally located and connected to an interior surface of said circular plate, configured with alternating flat and raised sections for timing actions of said knife gate assembly.

4. An energy conversion system as claimed in claim 3, wherein said heating chamber is an external combustion chamber.

5. An energy conversion system as claimed in claim 4, wherein said heating chamber further comprises:

an insulated heating chamber housing;

an entrance for a fuel and air mixture;

piping and burner jets configured to convey fuel and air mixture into said heating chamber;

an exit for said fuel and air mixture once combusted;

at least one heating or vaporizing tube, configured within said heating chamber, for pressurizing a fluid;

at least one gas or vapor storage vessel.

6. An energy conversion system as claimed in claim 3, wherein said heating chamber is configured to use a heated fluid from an external source to heat the fluid contained within said energy conversion system.

7. An energy conversion system as claimed in claim 6 wherein said external source of said heated fluid is a fluid waste heat stream.

8. An energy conversion system as claimed in claim 6, wherein said heating chamber further comprises:

an insulated heating chamber housing;

an entrance for a heated fluid from an external source;

an exit for said heated fluid from an external source;

at least one heating or vaporizing tube, configured within said heating chamber, for pressurizing a fluid;

at least one gas or vapor storage vessel.

9. An energy conversion system as claimed in claim 3, wherein said toroidal motor further comprises:

a magnetic coupling assembly used to transfer said mechanical energy to a user, comprising:

a driving portion of said magnetic coupling assembly, connected to an output end of said output shaft, internal to a toroidal motor housing;

a driven portion of said magnetic coupling assembly, external to said toroidal motor housing; and, a portion of said toroidal motor housing, configured to separate said driving portion of said magnetic coupling assembly from said driven portion of said magnetic coupling assembly, and configured to make said toroidal motor housing substantially sealable.

* * * * *